US007066484B2

(12) United States Patent
Willis et al.

(10) Patent No.: US 7,066,484 B2
(45) Date of Patent: Jun. 27, 2006

(54) FOLDABLE MOBILITY SUPPORT DEVICE

(76) Inventors: Phillip M. Willis, 8035 Royal Saint Georges La., Duluth, GA (US) 30097; Christopher D. Sanders, 3780 Mansell Rd., Suite T-50, Alpharetta, GA (US) 30022

( * ) Notice: Subject to any disclaimer, the term of this patent is extended or adjusted under 35 U.S.C. 154(b) by 0 days.

(21) Appl. No.: 11/129,569

(22) Filed: May 13, 2005

(65) Prior Publication Data

US 2005/0257819 A1 Nov. 24, 2005

Related U.S. Application Data

(63) Continuation of application No. 10/680,596, filed on Oct. 7, 2003.

(51) Int. Cl.
*A61H 3/04* (2006.01)

(52) U.S. Cl. ..... 280/642; 280/647; 280/47.4

(58) Field of Classification Search ..... 280/87.01, 280/87.051, 87.021, 87.041, 47.34, 47.38, 280/47.4, 639, 642, 646, 647, 650; 135/65, 135/67, 74

See application file for complete search history.

(56) References Cited

U.S. PATENT DOCUMENTS

| | | | | |
|---|---|---|---|---|
| 5,060,967 | A * | 10/1991 | Hulterstrum | 280/650 |
| 5,072,958 | A * | 12/1991 | Young | 280/40 |
| 5,772,234 | A * | 6/1998 | Luo | 280/642 |
| 6,338,493 | B1 * | 1/2002 | Wohlgemuth et al. | 280/30 |
| 6,378,883 | B1 * | 4/2002 | Epstein | 280/250.1 |
| 6,659,478 | B1 * | 12/2003 | Hallgrimsson et al. | 280/47.36 |
| 6,688,633 | B1 * | 2/2004 | van't Schip | 280/642 |
| 6,695,324 | B1 * | 2/2004 | Wu | 280/47.315 |
| 6,837,503 | B1 * | 1/2005 | Chen et al. | 280/87.021 |
| 6,863,296 | B1 * | 3/2005 | Yoshie et al. | 280/642 |

* cited by examiner

*Primary Examiner*—Christopher P. Ellis
*Assistant Examiner*—Brian L. Swenson
(74) *Attorney, Agent, or Firm*—Malloy & Malloy, P. A.

(57) ABSTRACT

A mobility device includes at least a first front leg and at least a first rear leg connected to the first front leg connected to the first front leg. The first rear leg includes an upper member having a first end a second end and a lower member having a first end and a second end. The first end of the upper member is pivotally connected to the first end of the lower member, and the lower member is preferably pivotal between an extended use position and a folded storage position.

16 Claims, 9 Drawing Sheets

FOLDABLE MOBILITY SUPPORT DEVICE

CLAIM OF PRIORITY

The present application is a continuation application of previously filed, now pending application having Ser. No. 10/680,596, filed on Oct. 7, 2003 incorporated herein by reference.

BACKGROUND OF THE INVENTION

1. Field of the Invention

The present invention generally relates to mobility support devices. More particularly, the invention relates to a foldable walker, in preferred embodiments.

2. Description of the Related Art

Elderly persons, disabled persons, surgery patients, etc., often require assistance when attempting to walk or move about. Walkers and canes are two devices typically used to provide such assistance by allowing a user to support a portion of his or her weight on the device, thereby providing increased stability to the user and removing weight normally supported by the user's extremities. Of the two devices, walkers provide more stability of the user. However, due to their size and general structure, walkers are often bulky and cumbersome to transport and store.

Because walkers are frequently transported between uses, some walkers are designed to be foldable so that they are easier to handle and require less space during transportation. For example, many walkers are sized such that they would not adequately fit into the trunk of a vehicle when they are in their fully extended use positions. A foldable walker is generally more easily lifted by a user and more likely to fit adequately within a vehicle. However, the collapsibility of known walkers is limited in that the walker still must offer the structural integrity needed to support the user. As such, many existing foldable walkers only partially fold and are still considerably bulky and cumbersome to carry and store in their folded positions. Various foldable walkers also include wheels and brake assemblies that render the walker less conductive to folding. For example, it is important to ensure that any handbrakes, cables, and wheel brake assemblies are not damaged and remain in proper functioning condition as the walker is repeatedly transitioned between and in-use positions.

Manufacturers and retailers may also benefit from a foldable walker that requires less storage space than those currently available. For example, from an economical standpoint, reducing the overall size of the foldable walker while in its folded position may translate into reduced shipping costs for the manufacturer. As well, reduced size requires that a retailer dedicate less shelf space to each walker being offered for sale.

From the foregoing, it can be appreciated that it would be desirable to have a stable yet foldable walker, or other device, thereby facilitating the transportation, storage, and use of the walker or device.

SUMMARY OF THE INVENTION

Briefly described, in one embodiment, among others, a foldable walker provides an apparatus for assisting a user with mobility. An embodiment, among others, of a foldable walker includes at least a first front leg and a least a first rear leg connected to the first front leg. The first rear leg includes an upper member having a first end and a second end and a lower member having a first end and a second end. The first end of the upper member is pivotally connected the first end of the lower member, and the lower member is preferably pivotal between an extended use position and a folded storage position.

Another embodiment, among others, of a foldable walker includes a first front leg, a second front leg, and a first cross-member. Each of the first and second front legs includes a first end and a second end, and the first cross-member connects the first and second front legs. A first rear leg is connected to the first front leg, and the first rear leg includes an upper member having a first end and a second end, and a lower member having a first end and a second end, and a hinge connecting the first end of the upper member to the first end of the lower member. A second rear leg is connected to the second front leg, and the second rear leg includes an upper member having a first end and a second end, a lower member has a first end and a second end, and a hinge connecting the first end of the upper member to the first end of the lower member. The lower members of the first and second rear legs are preferably pivotal between an extended use position and a folded storage position.

Other systems, methods, features, and advantages of the present foldable walker will be or become apparent to one with skill in the art upon examination of the following drawings and detailed description. It is intended that all such additional systems, methods, features, and advantages be included within this description.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Figure 1:
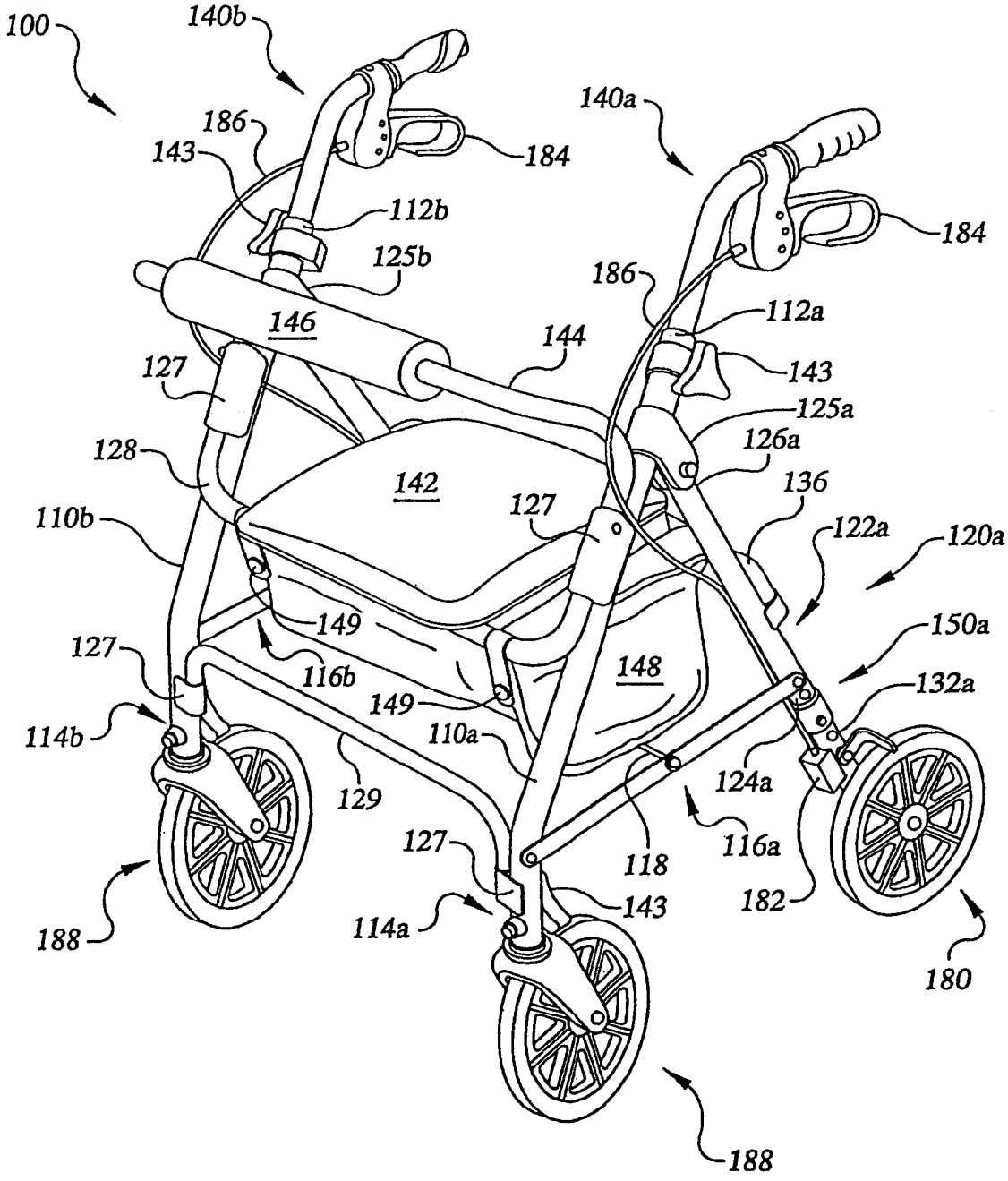
FIG. 1 is a front perspective view of an embodiment, among others, of a foldable walker.

Reference will now be made in detail to the description of the foldable walker as illustrated in the drawings. While the foldable walker will be described in connection with these drawings, there is no intent to limit it to embodiment or embodiments disclosed therein.

Like reference numerals refer to like parts throughout the several views of the drawings.

DETAILED DESCRIPTION OF THE PREFERRED EMBODIMENT

Figure 2:
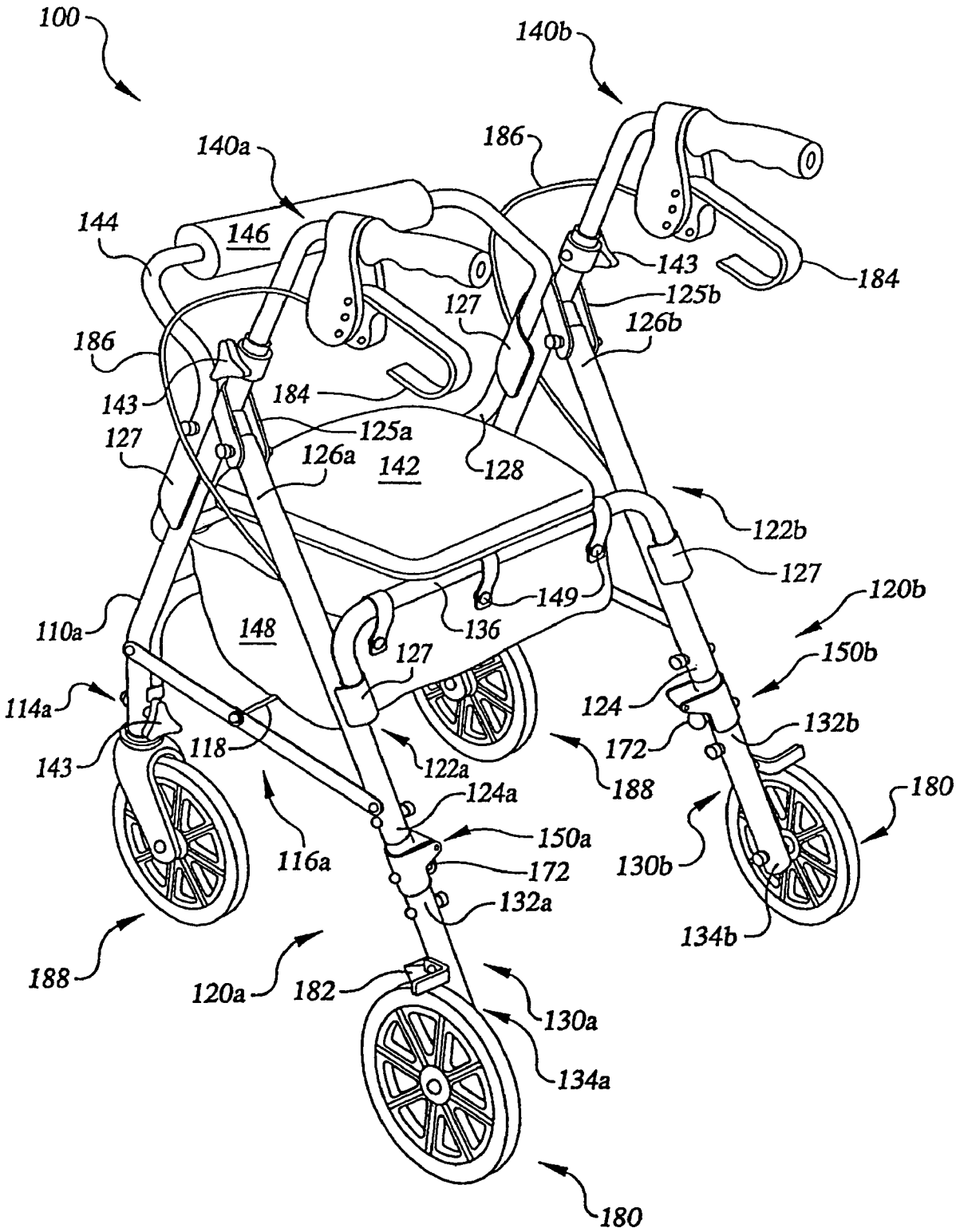
FIG. 2 is a rear perspective view of the foldable walker as shown in FIG. 1.
Figure 3:
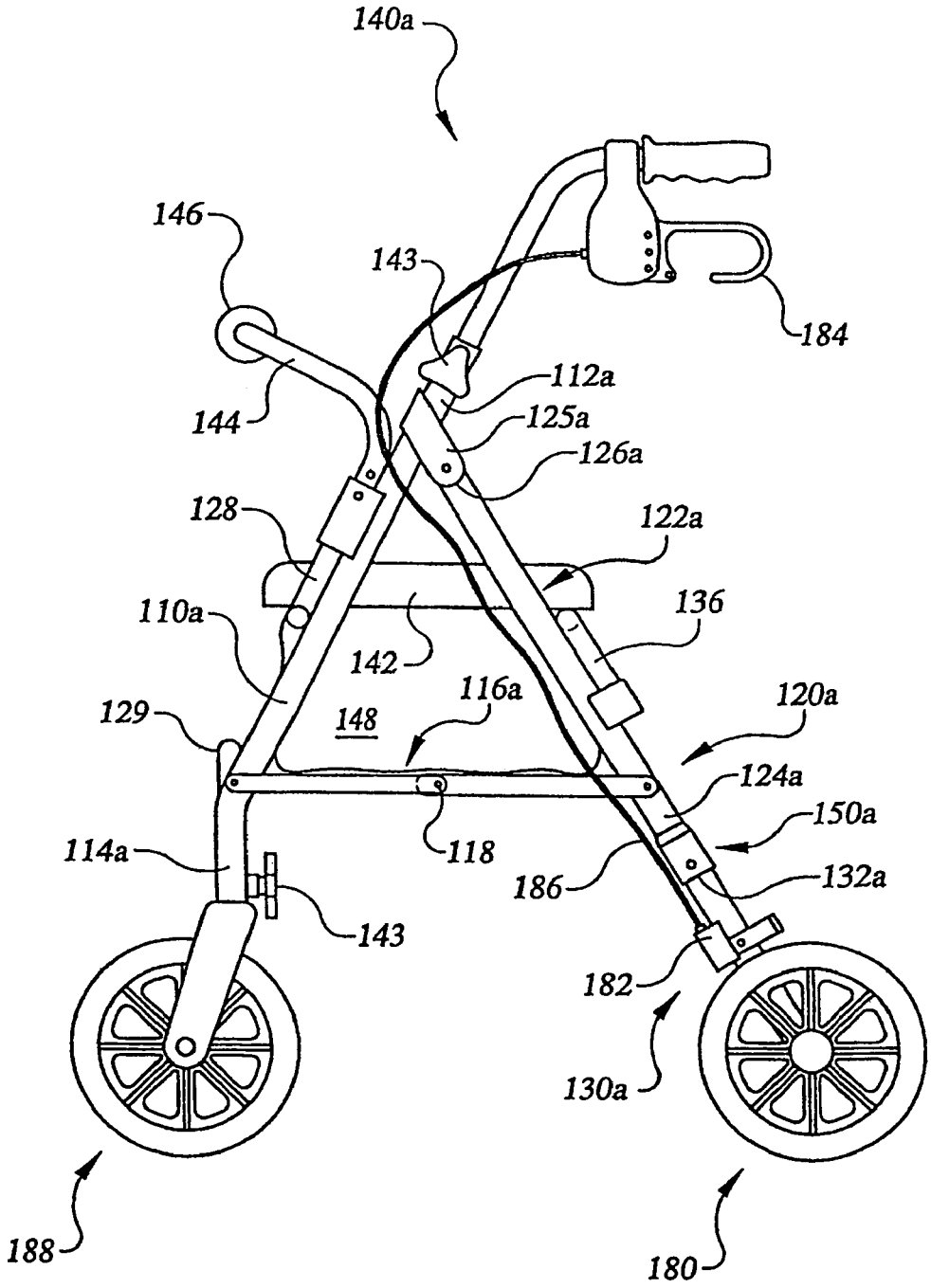
FIG. 3 is a side view of the foldable walker shown in FIG. 1.

Referring now in more detail to the drawings, FIGS. 1–3 illustrate an embodiment of a foldable walker 100. As shown, the foldable walker 100 includes a first leg 110*a* and a second front leg 100*b* secured to each other by at least a first cross member 128. The first front leg 110*a* and a second front leg 110*b* are each pivotally connected to a first rear leg 120*a* and a second rear leg 120*b*, respectively. The first and second rear legs 120*a*, 120*b* each include an upper member 122*a*, 122*b* hingably attached to a respective lower member 130*a*, 130*b* by hinge assemblies 150*a*, 150*b*, respectively, as is discussed in greater detail hereinafter. Preferably, the first upper member 122*a* and a second upper member 122*b* are connected by a second cross member 136 which is positioned so as to be the same height above a support surface beneath the foldable walker 100 as the first cross member 128. Additional cross members, such as cross member 129, may (though not necessarily in all embodiments) be provided between the first and second front legs 110*a*, 110*b* and the first and second upper members 122*a*, 122*b* to provide additional stability to the foldable walker 100. Preferably, the first cross member 128, the second cross member 136, and cross member 129 are welded to brackets 127 which are in turn welded to their respective legs of the foldable walker 100. Of course, other connection structures are also considered to be within the scope of the present invention. Further, the first and front legs 110*a*, 110*b* are preferably connected to the first and second upper members 122*a*, 122*b*, respectively, by folding brackets 116*a* and 116*b*. The first and second folding brackets 116*a*, 116*b* are preferably connected to each other with a tie rod 118 and are configured such that the folding brackets 116*a*, 116*b* only collapse when the tie rod 118 is pushed upwardly away from the support surface beneath the foldable walker 100.

Figure 4A:
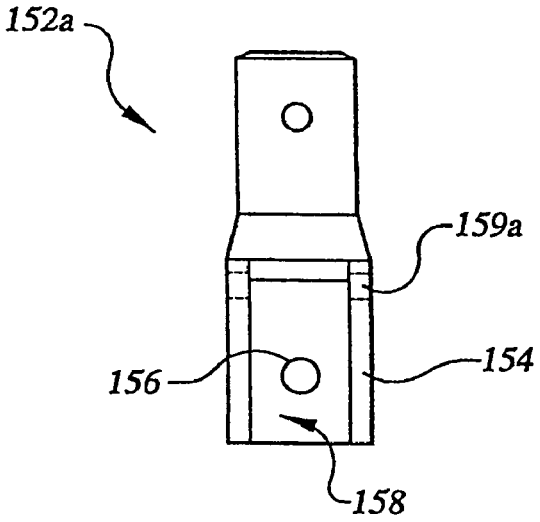
FIGS. 4*a* and 4*b* are front and side views of an upper portion of an embodiment of a hinge assembly as used on the foldable walker shown in FIG. 1.
Figure 4B:
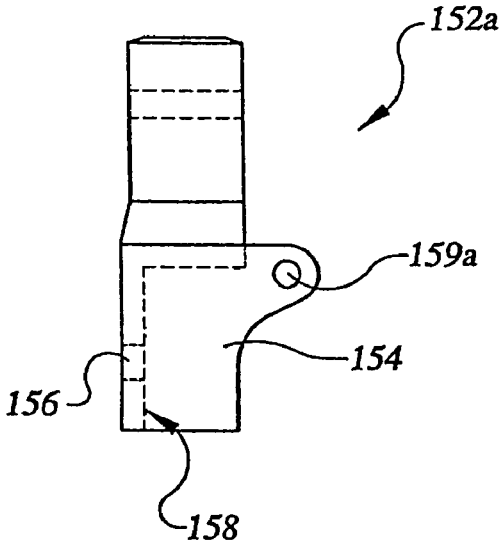
Figure 5A:
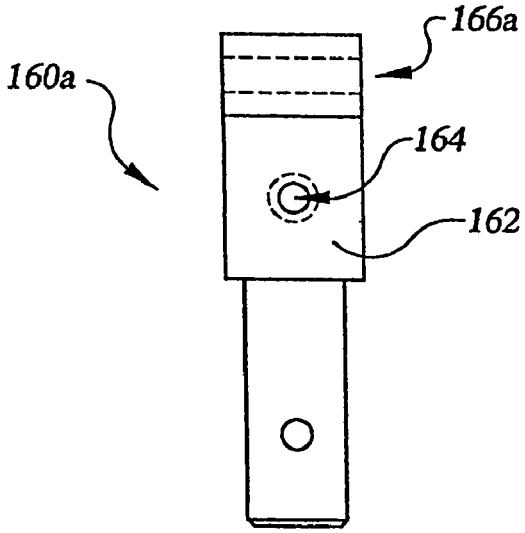
FIGS. 5*a* and 5*b* are front and side views of a lower portion of an embodiment of a hinge assembly as used on the foldable walker shown in FIG. 1.
Figure 5B:
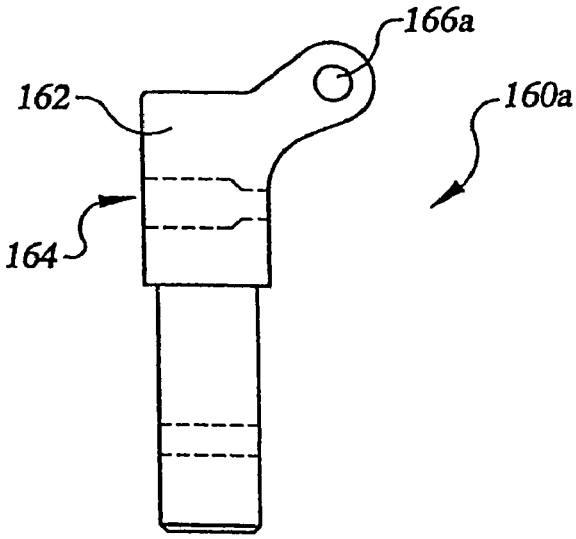

As previously noted, and as best shown in FIG. 2, the first and second upper members 122*a*, 122*b* are hingably connected to the first and second lower members 130*a*, 130*b* by first and second hinge assemblies 150*a*, 150*b*, respectively. For ease of description, only the first rear leg 120*a* will be discussed. As shown, the second end 126*a* of the first upper member 122*a* is preferably rotatably connected through a pivot structure, such as a pivot assembly 125*a*, to the front leg 110*a*. Similarly, pivot assembly 125*b* rotatably connects the second end 126*b* to the second front leg 110*b*. The upper portion 152*a* (FIGS. 4*a* and 4*b*) of the first hinge assembly 150*a* is secured to the first end 124*a* of the upper member 122*a*. Similarly, the lower portion 160*a* (FIGS. 5*a* and 5*b*) is mounted to the first end 132*a* of the first lower member 130*a*. By passing an axle 166 through corresponding axle apertures 159*a* in the upper portion 152*a* and a corresponding axle channel 166*a* in the lower portion 160*a*, the upper and lower portions 152*a*, 160*a* are hingably secured to each other. As such, the first lower member 130*a* is secured to the first member 122*a*, as shown in FIGS. 1–3. As shown in FIGS. 6*a*–6*d*, the lower portion 160*a* includes a locking pin 170 that is threadably secured to a low profile button 172 to facilitate operating the first hinge assembly 150*a*. As well, the locking pin 170 is biased by a spring 174. Operation of the first and second hinge assemblies 150*a*, 150*b* and the foldable walker 100 are discussed in greater detail hereinafter.

Referring back to FIGS. 1–3, preferred embodiments of the foldable walker 100 may include a seat 142 supported by the first and second cross members 128, 136, and a backrest 144 supported between the first and second front legs 110*a*, 110*b*. Preferably, the seat 142 is configured to rotate about the first cross member 128 such that the seat 142 can be rotated toward the backrest 144, thereby exposing a storage compartment 148 disposed beneath the seat 142. Preferably, the storage compartment 148 is supported by the first and second cross members 128, 136. As shown, the storage compartment 148 comprises a bag secured to the first and second cross members 128, 136 with a plurality of snaps 149 that permit the storage compartment 148 to be removed. However, embodiments are envisioned wherein the storage compartment 148 comprises a wire mesh basket or other like structure. As shown, the backrest 144 includes a pad 146 for the comfort of the user.

Preferably, each leg of the foldable walker 100 includes a wheel assembly. First and second front legs 110*a*, 110*b* each include a front wheel assembly 188 disposed at the second end 114*a*, 114*b* of each leg. As shown, front wheel assemblies 188 are preferably caster-mounted such that they are fully rotatable about the first and second front legs 110*a*, 110*b*, thereby increasing the maneuverability of the foldable walker 100. The first and second rear legs 120*a*, 120*b* each include a rear wheel assembly 180 disposed on the second end 134*a*, 134*b* of the first and second lower members 130*a*, 130*b*. Preferably, the rear wheel assemblies 180 are not caster-mounted and therefore do not pivot about the first and second rear legs 120*a*, 120*b*. The first and second front legs 110*a*, 110*b* further include a first and second handlebar 140*a*, 140*b* adjustably connected to the first end 112*a*, 112*b* of each front leg 110*a*, 110*b*, respectively. Preferably, the first and second handlebars 140*a*, 140*b* are secured to the walker 100 with easily manipulated threaded knobs 143, as are other parts of the walker 100. The first and second handlebars 140*a*, 140*b* are connected to the first and second front legs 110*a*, 110*b* such that they can be adjusted based upon the height of the user. Also, each handlebar 140*a*, 140*b* includes a lever 184, which is used to activate a brake 182 that is adjacent the rear wheel assemblies 180. By urging the lever 184 upwardly toward the respective handlebar 140*a*, 140*b*, a cable 186 is pulled which in turn causes the brake 182 to engage the rear wheel assembly 180, thereby preventing the foldable walker 100 from rolling. Further, the levers 184 may be manipulated such that the brakes 182 are activated although the user is no longer exerting force on the lever 184.

Figure 6A:
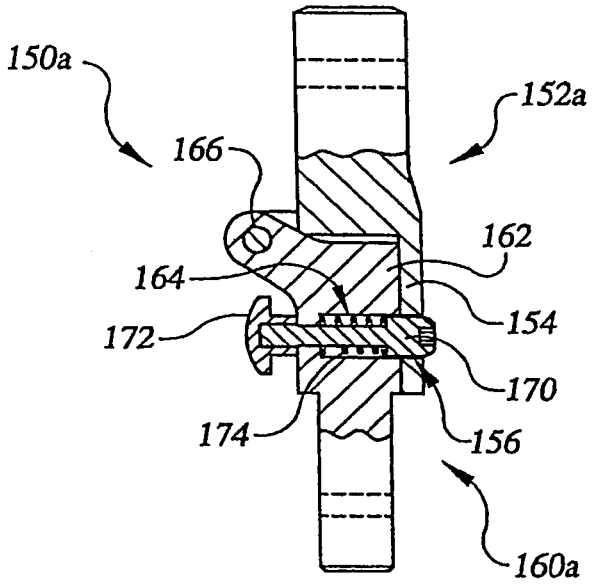
FIGS. 6*a*–6*d* are partial, cut-away side views of an embodiment of a hinge assembly, including upper and lower portions as shown in FIGS. 4*a*–4*b* and 5*a*–5*b*, respectively, as used with the foldable walker shown in FIG. 1.

As shown in FIGS. 1–3, the foldable walker 100*b* is configured to assist a user to walk while the first and second lower members 130*a*, 130*b* are locked in their fully extended use positions. For ease of description, only the first hinge assembly 150*a* is discussed. During use, first hinge assembly 150*a* is configured as shown in FIG. 6*a*, as viewed from the front of the walker 100. The core 162 of lower portion 160*a* is disposed within sleeve 154 of the upper portion 152*a*. The core 162 is secured in position by a locking pin 170 that extends through both the upper portion 152*a* and a lower portion 160*a*. As shown, when the core 162 is properly seated within the sleeve 154, a locking channel 164 that houses the locking pin 170 aligns with a locking aperture 156 formed in the sleeve 154. The locking channel 164 also houses a spring 174, which biases the locking pin 170 such that a portion of the locking pin 170 extends outwardly from the locking channel 164 and engages the locking aperture 156.

Figure 7:
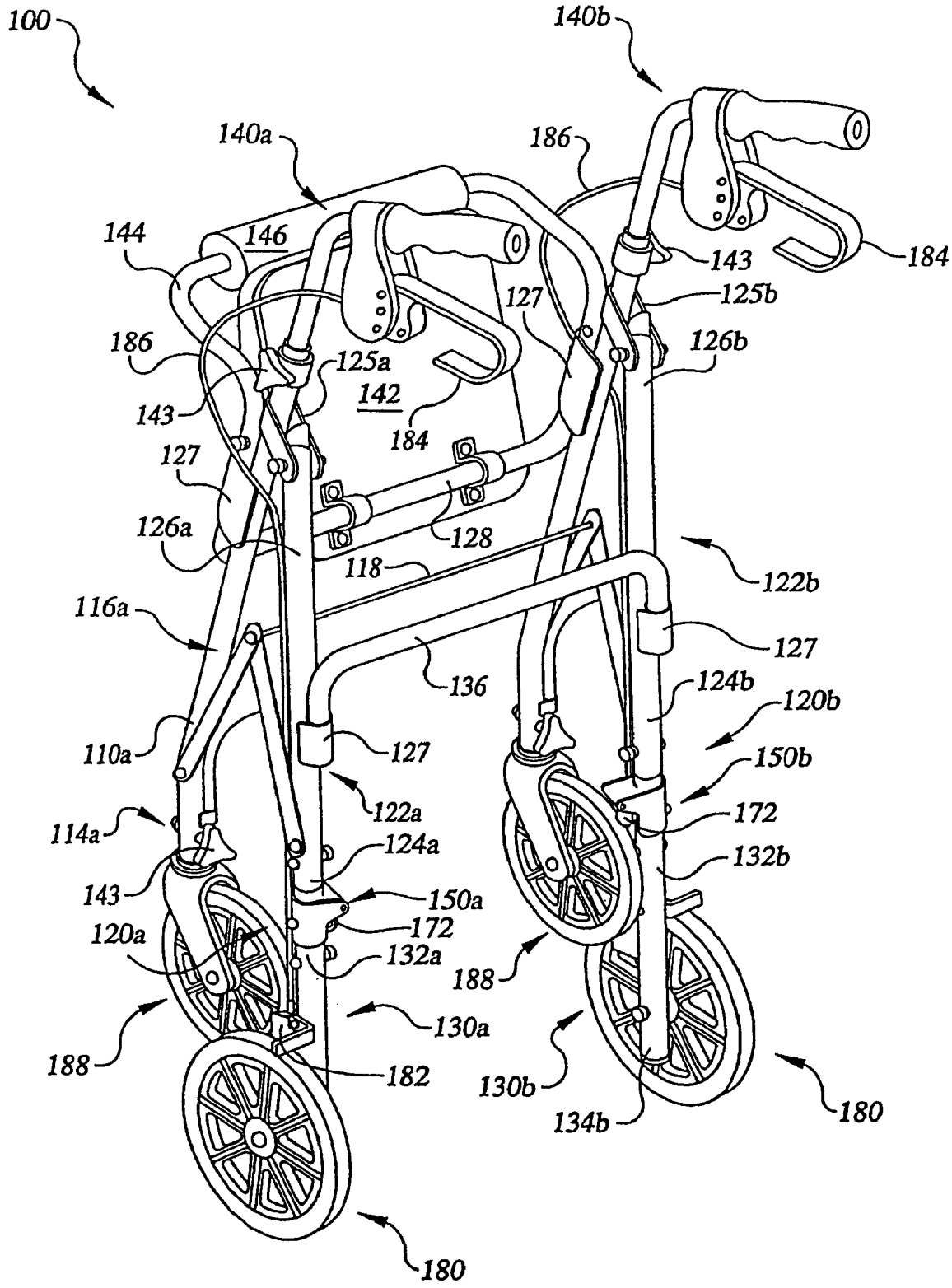
FIG. 7 is a rear perspective view of the foldable walker shown in FIG. 1, in a partially folded position.
Figure 8:
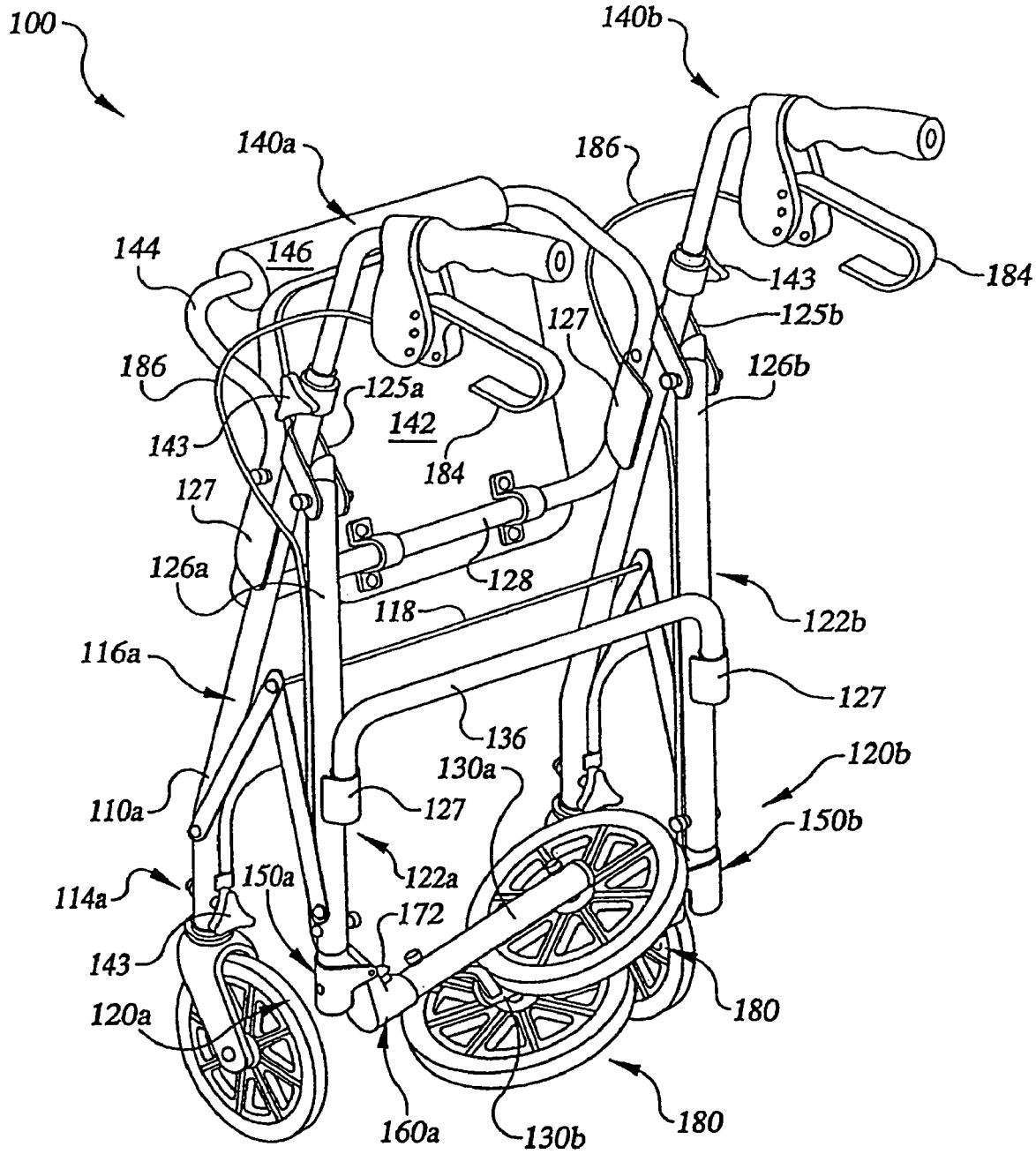
FIG. 8 is a rear perspective view of the foldable walker shown in FIG. 1, in a fully folded position.
Figure 9:
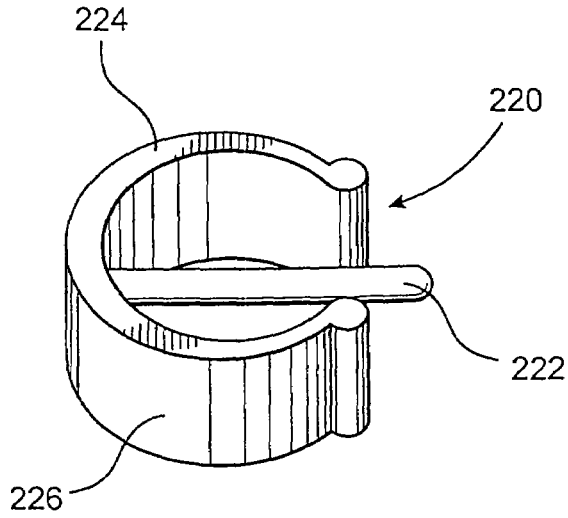
FIG. 9 is a perspective view of a retaining connector used in at least one preferred embodiment of the present invention to retain a wheel assembly in connected relation to a corresponding leg assembly.
Figure 10:
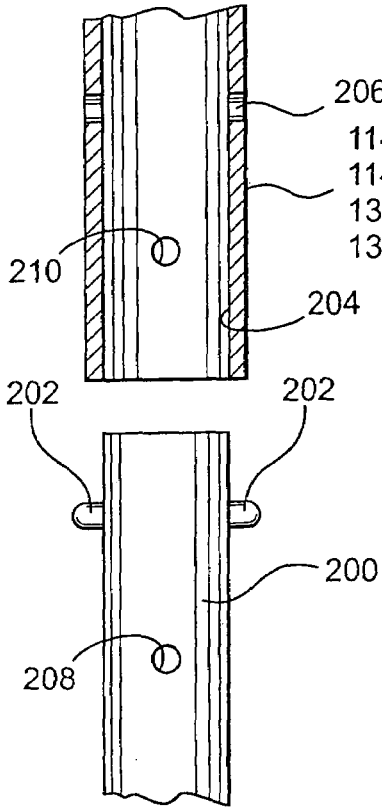
FIG. 10 is a front view in partial cutaway of corresponding connecting portions of the front and/or rear leg assemblies with the front and/or rear wheel assemblies.
Figure 11:
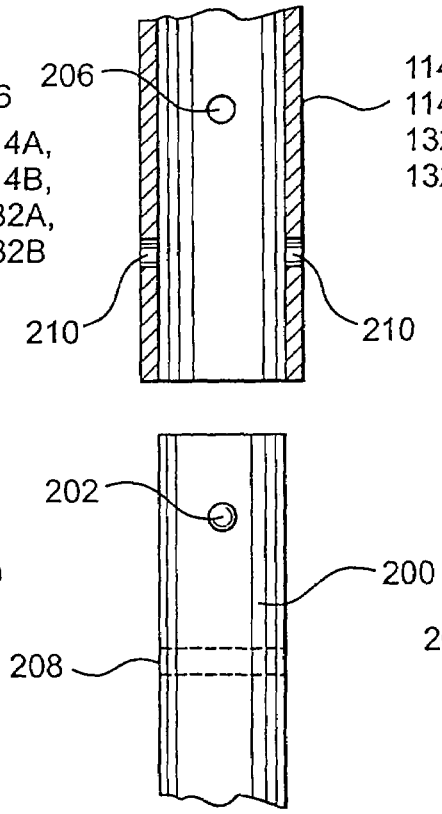
FIG. 11 is a side view in partial cutaway of the embodiment of FIG. 10.
Figure 12:
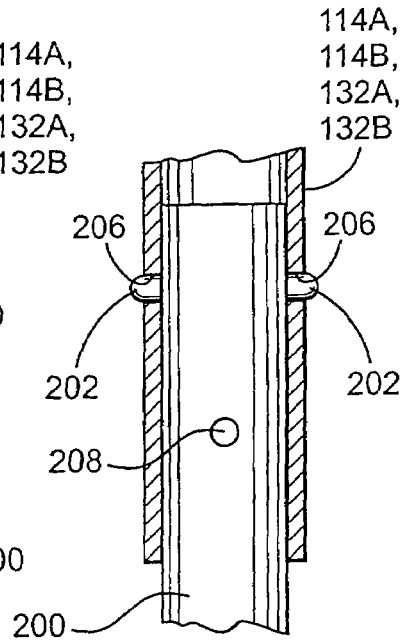
FIG. 12 is a front view in partial cutaway of the embodiments of FIGS. 10 and 11 in a connected or assembled position.

To fold the foldable walker 100, the user first pushes upwardly on one of the folding brackets 116*a*, 116*b* or the tie rod 118. As the tie rod 118 moves upwardly the first and second rear legs 120*a*, 120*b* rotate toward the first and second front legs 110*a*, 110*b* about the pivot points adjacent the second ends 126*a*, 126*b* of the first and second upper members 122*a*, 122*b*. The first and second rear legs 120*a*, 120*b* will rotate inwardly until the walker is configured in the manner shown in FIG. 7. The walker is shown in FIGS. 7 and 8 without the storage compartment 148 in order to more clearly show the folding operation.

Figure 6B:
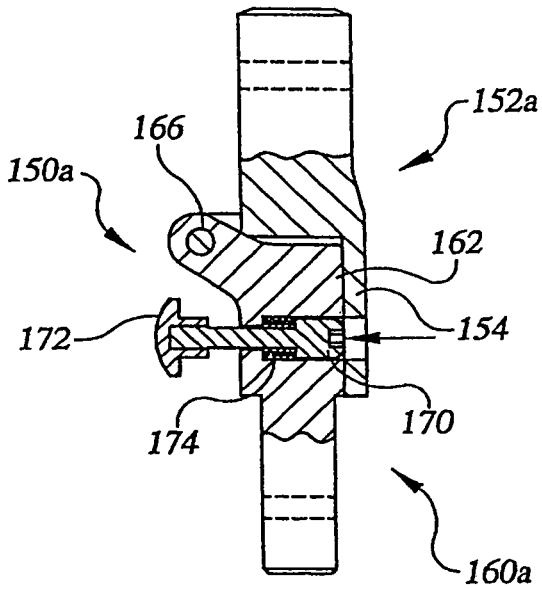
Figure 6C:
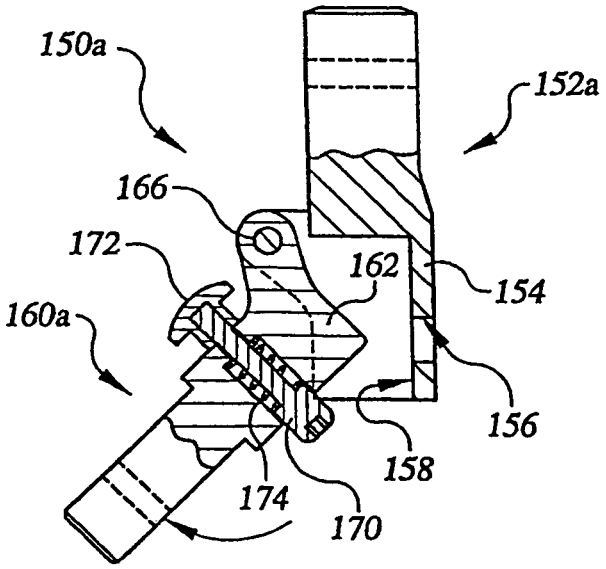

To further reduce the overall size of the foldable walker 100, a user can fold the lower members 130*a*, 130*b* of the first and second rear legs 120*a*, 120*b* and their associated rear wheel assemblies 180 inwardly toward one another. In order to fold first lower member 130*a* into a storage position, the user first pulls button 172 inwardly toward the center line of the foldable walker 100. In doing so, the user compresses the spring 174 and causes the locking pin 170 to be disengaged from the locking aperture 156 of the upper portion 152*a*, as shown in FIG. 6*b*. After the locking pin 170 is disengaged from the locking aperture 156 the lower portion 160*a* is pivotal about the axis 166 (FIG. 6*c*), thereby allowing lower member 130*a* to be swung into its folded storage position, as shown in FIG. 8. Similar steps are performed on the second hinge assembly 150*b* so that lower member 130*b* can be swung into its folded storage position.

Figure 6D:
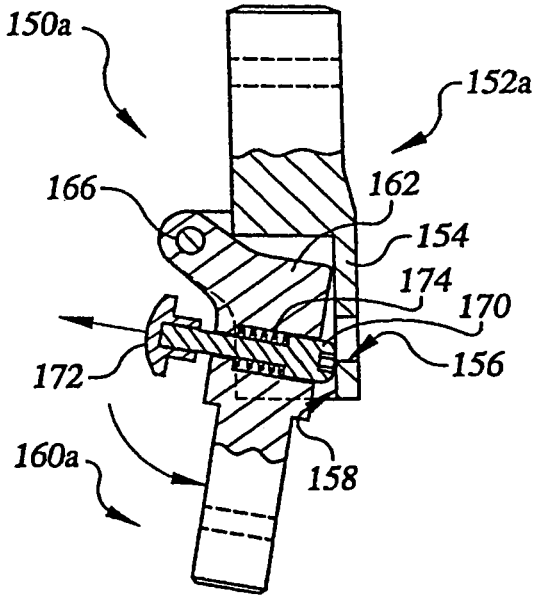

Once a user releases the button 172, the spring 174 causes the locking pin 170 to be urged outwardly from the core 162 into its fully extended position. To lock the wheels in place for use once again, the user may pivot the first lower member 130*a* downwardly from its storage position until the locking pin 170 encounters camming surface 158, as shown in FIG. 6*d*. As lower member 130*a* continues to be rotated into alignment with upper member 122*a*, the locking pin 170 travels along the camming surface 158, subsequently causing the spring 174 to be compressed and the button 172 to be urged away from the lower portion 160*a* of the first hinge assembly 150*a*. Eventually, the locking pin 170 encounters the locking aperture 156 and extends therethrough because of the biasing effect of the spring 174, as shown in FIG. 6*a*. After the lower member 130*b* has been similarly positioned, the first and second front legs 110*a*, 110*b* and the first and second rear legs 120*a*, 120*b* are urged outwardly away from each other thereby causing folding brackets 116*a*, 116*b* to become fully extended. With the lower members 130*a*, 130*b* so positioned, the foldable walker 100 is configured to assist a user in walking.

Preferably, the locking pin 170 is configured such that it is not likely to be inadvertently disengaged from the locking aperture 156. For example, as shown in FIGS. 6*a*–6*d*, the button 172 is shaped such that it is of a low profile and is therefore not prone to being snagged or pulled during use. As well, it is preferable that the button 172 is shielded by a portion of the hinge assembly 150. As best shown in FIG. 6*a*, the button 172 is shielded by the portion of the hinge assembly 150*a* that houses the axle 166. However, the button as shown is merely one embodiment and numerous other shapes are envisioned.

Yet another preferred embodiment of the present invention is represented in FIGS. 9 through 14 and may be substituted, at least in part, from the use of the hinge assemblies 150A and 150B as explained above and as represented in detail in the above-described figures. More specifically, in order to compact the configuration and reduce at least the longitudinal dimension of the frame of the walker assembly 100 and possibly the transverse dimension thereof as well, the front and rear wheel assemblies may be removed from the front and rear leg assemblies. For purposes of clarity, the additional preferred embodiments of FIGS. 9 through 14 represent a single lower leg portion. However, it is emphasized that in describing this particular structure, each of the front and rear legs, 114A, 114B, 132A, 132B is the duplicate and/or structural equivalent of one another such that the description of one lower leg portion is meant to be descriptive of each of the corresponding leg structures. Further, member 200 defines the outwardly extending shaft to which each of the wheel structures 188 and 180 are secured.

Figure 13:
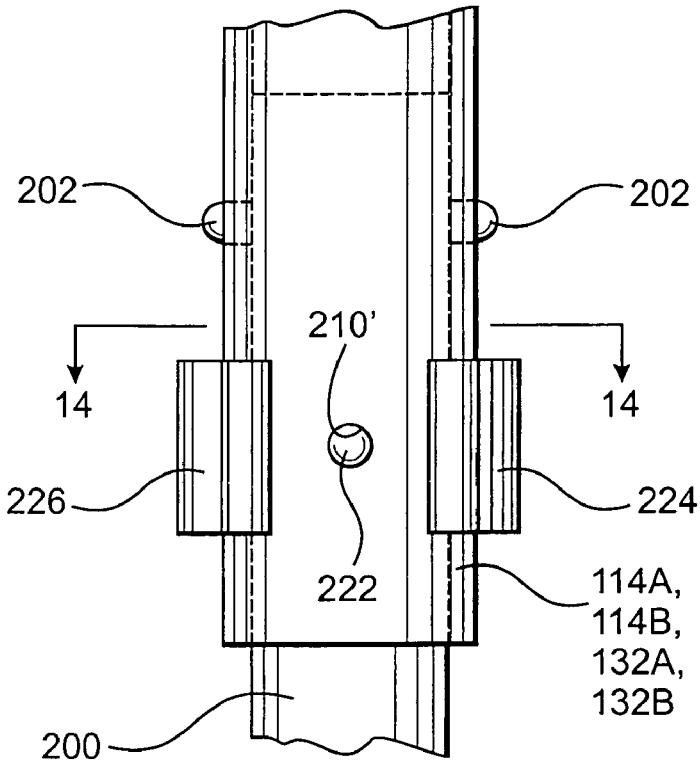
FIG. 13 is a front view in partial cutaway of the embodiment of FIG. 12 with the retaining connector, represented in FIG. 9, disposed in a retaining position relative to the correspondingly connected leg and wheel assemblies.
Figure 14:
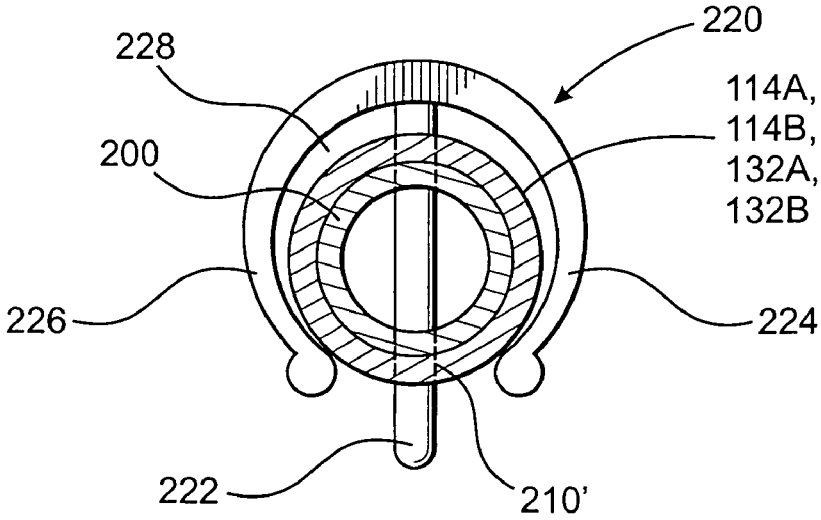
FIG. 14 is a sectional view along line 14—14 of FIG. 13.

Accordingly as clearly shown in FIGS. 10 through 13, the transverse dimension of the shaft 200 is at least minimally less than the interior transverse dimension of the lower portion 114A, etc, of the front and rear leg assemblies. This relative dimensioning allows for the shaft 200 to be inserted within and removed from the interior of the lower portion 114A, etc, as demonstrated by a comparison of the unassembled and assembled structures respectively represented in FIGS. 10–11 and 12. Further, the shaft 200 includes spring bias fingers 202 which are retractable, at least partially, into the interior of the shaft 200 as they pass along the interior surface 204 of the lower portion of the leg 114A, etc. However, upon the spring bias fingers 202 being aligned with coaxial apertures 206, the fingers 202 will expand outwardly thereby removably locking or retaining the shaft 200 within the interior of the leg lower portion 114A, etc. Removal of the shaft 200 from the interior of the leg lower portion 114A, etc. is accomplished by inwardly depressing the fingers 202 such that they are removed from the apertures 206 and are allowed to slide along the interior surface 204. However, once the fingers 202 are aligned with and extend outwardly from the apertures 206, apertures 208 and 210, respectively formed in the shaft 200 and the leg lower portion 114A, etc, will be axially aligned. Such axial alignment between the apertures 208 and 210 will facilitate the connection of a retaining connector or bracket 220 in its intended, retaining position as best shown in FIGS. 13 and 14.

More specifically, the retaining connector or bracket 220 comprises central connecting pin or shaft 222 spaced inwardly from curved arms 224 and 226. The free ends of the each of the arms 224 and 226 are disposed in spaced relation to one another so as to facilitate passage of lower leg portion 114A, etc, there between and into the interior 228 of the retaining connector structure 220 and between the arms 224 and 226. Further, the retaining connector or bracket 220 preferably includes the arms 224 and 226 being formed from a flexible material and as such may expand outwardly to further facilitate passage of the lower leg portion 114A, etc. into the interior 208 of the retaining connector 220. In the connected position shown in FIGS. 13 and 14, the retaining pin 222 therefore passes through axially aligned apertures 208 and 210. Also, the retaining pin 220 is preferably of sufficient length to pass outwardly from the outermost aperture 210 as also shown in FIGS. 13 and 14.

Additional structural features include an axially adjustable and removable handle assembly, comprising first and second handlebars 140*a*, 140*b* adjustably connected to the first end 112*a*, 112*b* of each front leg 110*a*, 110*b*, respectively. Preferably, the first and second handlebars 140*a*, 140*b* are secured to the walker assembly 100 with easily manipulated threaded knobs 143, as are other parts of the walker 100. The first and second handlebars 140*a*, 140*b* are connected to the first and second front legs 110*a*, 110*b* such that they can be axially adjusted based upon the height of the user. Also, each handlebar 140*a*, 140*b* includes a lever 184, which is used to activate a brake 182 that is adjacent the rear wheel assemblies 180. By urging the lever 184 upwardly toward the respective handlebar 140*a*, 140*b*, a cable 186 is pulled which in turn causes the brake 182 to en a e the rear wheel assembly 180, thereby preventing the foldable walker 100 from rolling. Further, the levers 184 may be manipulated such that the brakes 182 are activated although the user is no longer exerting force on the lever 184.

It should be emphasized that the above-described embodiments of the present foldable walker 100, particularly, any "preferred" embodiments, are merely possible examples of implementations and merely set forth for a clear understanding of the principles of the foldable walker 100. Many variations and modifications may be made to the above-described embodiments(s) of the foldable walker 100 without departing substantially from the spirit and principles of the foldable walker 100. All such modifications and variations are intended to be included herein within the scope of this disclosure and the present foldable walker 100 and protected by the following claims.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A walker assembly structured to facilitate an individual's mobility, said walker assembly comprising:

a frame selectively disposable between an operative orientation and a stored orientation, said frame including a front leg assembly and a rear leg assembly movably interconnected and disposable relative to one another between said operative and stored orientations, a front wheel assembly and a rear wheel assembly respectively connected to a lower portion of corresponding ones of said front and rear leg assemblies, at least one of said front or rear leg assemblies structured to have a variable length when disposed between said operative and stored orientations, said stored orientation at least partially defined by said frame having a compact configuration of substantially reduced transverse and longitudinal dimensions, and said stored orientation comprising at least one of said front or rear leg assemblies including a lower portion disposable into a folded storage position and thereby at least partially defining said reduced longitudinal dimension.

2. A walker assembly recited in claim 1 wherein said stored orientation comprises said front and rear leg assemblies disposed in adjacent, substantially aligned relation along a length of said frame and thereby at least partially defining said reduced transverse dimension.

3. A walker assembly as recited in claim 1 further comprising a handle assembly adjustably connected to at least one of said front or rear leg assemblies.

4. A walker assembly as recited in claim 1 wherein said operative orientation comprises said front and rear leg assemblies movably connected and disposed in spaced, angularly oriented relation to one another.

5. A walker assembly recited in claim 1 wherein said one front or rear wheel assembly is connected to said lower portion of a corresponding one of said front or rear leg assemblies and movable therewith into said folded storage position.

6. A walker assembly as recited in claim 5 wherein said stored orientation further comprises the other of said front or rear wheel assemblies removed from the corresponding one of said front or rear leg assemblies.

7. A walker assembly as recited in claim 1 further comprising a hinge assembly pivotally interconnecting a lower portion and an upper portion of at least one of said front and rear leg assemblies, said hinge assembly structured to facilitate disposition of said lower portion between a folded storage position and an extended use position.

8. A walker assembly recited in claim 7 wherein said hinge assembly comprising a spring biased locking pin disposed to extend through both said upper portion and said lower portion, said lower portion removably secured in said extended use position.

9. A walker assembly as recited in claim 7 wherein said stored orientation comprises said front and rear leg assemblies disposed in adjacent, substantially aligned relation along a length of said frame and thereby at least partially defining said reduced transverse dimension.

10. A walker assembly structured to facilitate an individual's mobility, said walker assembly comprising:

a frame selectively disposable between an operative orientation and a stored orientation, said frame including a front leg assembly and a rear leg assembly movably connected and relatively disposable between said operable and stored orientations, said operative orientation comprising said front and rear leg assemblies movably connected and disposed in spaced, angularly oriented relation to one another, said stored orientation comprising said front and rear leg assemblies disposed in adjacent, substantially aligned relation along a length of said frame, a front wheel assembly and a rear wheel assembly respectively connected to said front and rear leg assemblies, said stored orientation at least partially defined by said frame assuming a compact configuration of substantially reduced transverse and longitudinal dimensions, said stored orientation comprising at least one of said front or rear wheel assemblies disposable into a folded storage position and thereby at least partially defining said reduced longitudinal dimension; and said one front or rear wheel assembly connected to said lower portion of a corresponding one of said front or rear leg assemblies and movable therewith into said folded storage position.

11. A walker assembly as recited in claim 10 further comprising a seat movably connected to said frame and disposable in a supporting position when said frame is in said operative orientation.

12. A frame assembly as recited in claim 11 wherein said seat is disposed in substantially aligned relation to said front and rear leg assemblies along a length of said frame when said frame is in said stored orientation and thereby at least partially defining said reduced transverse dimension.

13. A walker assembly as recited in claim 12 further comprising a storage compartment connected to said frame and disposable between an expanded position and a collapsed position when said frame is in said operative orientation and said stored orientation respectively.

14. A walker assembly as recited in claim 12 wherein said seat is disposed in substantially covering relation to an interior of said storage compartment when said frame is in said operative orientation.

15. A walker assembly as recited in claim 14 wherein said seat is disposable in confronting relation to said back rest when said frame is in said operative orientation.

16. A walker assembly as recited in claim 10 wherein said stored orientation further comprises the other of said front or rear wheel assemblies removed from the other of said front or rear leg assemblies.

* * * * *